US006902374B2

(12) United States Patent
Pearce

(10) Patent No.: US 6,902,374 B2
(45) Date of Patent: Jun. 7, 2005

(54) CEILING FAN

(75) Inventor: Richard A. Pearce, Byhalia, MS (US)

(73) Assignee: Hunter Fan Company, Memphis, TN (US)

( * ) Notice: Subject to any disclaimer, the term of this patent is extended or adjusted under 35 U.S.C. 154(b) by 35 days.

(21) Appl. No.: 10/414,544

(22) Filed: Apr. 15, 2003

(65) Prior Publication Data

US 2004/0208747 A1 Oct. 21, 2004

(51) Int. Cl.[7] ..... F04D 29/00

(52) U.S. Cl. ..... 416/5; 416/210 R; 416/207; 416/206

(58) Field of Search ..... 416/5, 204 R, 416/210 R, 205, 206, 207, 214 R; 403/329

(56) References Cited

U.S. PATENT DOCUMENTS

| | | | | |
|---|---|---|---|---|
| 4,187,056 | A | 2/1980 | Schwinn et al. | 416/507 |
| 4,197,054 | A | 4/1980 | Morrill | 416/93 |
| 4,245,960 | A | 1/1981 | Matthews | 416/244 |
| 5,102,302 | A | 4/1992 | Schilling et al. | 416/224 |
| 5,354,176 | A | 10/1994 | Schilling et al. | 416/204 |
| 5,458,464 | A | 10/1995 | Lee | 416/210 |
| 5,951,253 | A | 9/1999 | Gajewski | 416/214 |
| 5,954,449 | A | 9/1999 | Wu | 403/315 |
| 5,980,353 | A | 11/1999 | Wu | 446/210 |
| 6,010,306 | A | 1/2000 | Bucher et al. | 416/210 |
| 6,022,191 | A | 2/2000 | Moore et al. | 416/134 |
| 6,039,540 | A | 3/2000 | Wu | 416/210 |
| 6,149,388 | A | 11/2000 | Liao | 416/210 |
| 6,155,787 | A | 12/2000 | Hodgkins, Jr. | 416/210 |
| 6,210,117 | B1 | 4/2001 | Bucher et al. | 416/210 |
| 6,250,885 | B1 | 6/2001 | Gajewski | 416/214 |
| 6,382,917 | B1 | 5/2002 | Zuege | 416/210 |
| 6,390,777 | B1 | 5/2002 | Kerr, Jr. | 416/204 |
| 6,508,629 | B2 | 1/2003 | Kerr, Jr. | 416/210 |

*Primary Examiner*—Edward K. Look
*Assistant Examiner*—Dwayne J. White
(74) *Attorney, Agent, or Firm*—Baker Donelson

(57) ABSTRACT

A ceiling fan comprising an annular array of blade irons (14) adapted to be rotatably driven by a motor, said blade irons having opposite sides (15) formed with at least one notch (18), a plurality of fan blades (25) with each blade bearing a bracket (28) having opposite side walls (32), each formed with at least one indentation (33) sized and positioned to be passed through said blade iron side notches, whereby the blades may be mounted to the blade irons by passing the blade bracket indentations through the blade iron notches and then sliding the brackets to a position with the bracket indentations unaligned with the blade iron notches thereby interlocking the blade brackets with the blade irons.

11 Claims, 5 Drawing Sheets

CEILING FAN

TECHNICAL FIELD

This invention relates to ceiling fans and more specifically to mechanisms by which their fan blades are mounted and dismounted.

BACKGROUND OF THE INVENTION

Electrically powered ceiling fans typically have a motor mounted within a stationary housing that is suspended from a ceiling. In operation, the motor rotates a blade iron that has an annulus from which individual extensions in the form of blade irons radiate. The several blades of the fan are mounted to these blade irons.

Ceiling fans are usually sold at retail with their blades packed separately from the fan housing for compactness. The housing is normally mounted in suspension from the ceiling through a downrod and then the blades are mounted to the blade irons. To do this, the blades have been mounted to the irons with screws or bolts. This has been cumbersome and tedious as the installer has had to be elevated on a ladder or platform and work above his head. This work has entailed aligning the mounting holes of the blade and blade iron and torquing the fasteners all while having to hold the blade above his head and often under poor lighting conditions . For blade replacement, the same task has been involved.

Accordingly, it is seen that a need has long existed for a ceiling fan capable of having its blades mounted and dismounted in a more efficient and easier manner. It is to the provision of such that the present invention is primarily directed.

SUMMARY OF THE INVENTION

In its preferred form, a ceiling fan comprises an annular array of blade irons adapted to be rotatably driven by a motor, said blade irons having opposite sides formed with at least one notch. The fan has fan blades with each blade bearing a bracket having opposite side walls, each formed with at least one indentation sized and positioned to be passed through a blade iron side notch. So constructed, the blades may be mounted to the blade irons by passing the blade bracket indentations through the blade iron notches and then sliding the brackets to a position with the bracket indentations unaligned with the blade iron notches thereby interlocking the blade brackets with the blade irons.

BRIEF DESCRIPTION OF THE DRAWINGS

FIG. 6A is a top view of a clip component of the fan while

DETAILED DESCRIPTION OF THE PREFERRED EMBODIMENT

Figure 1:
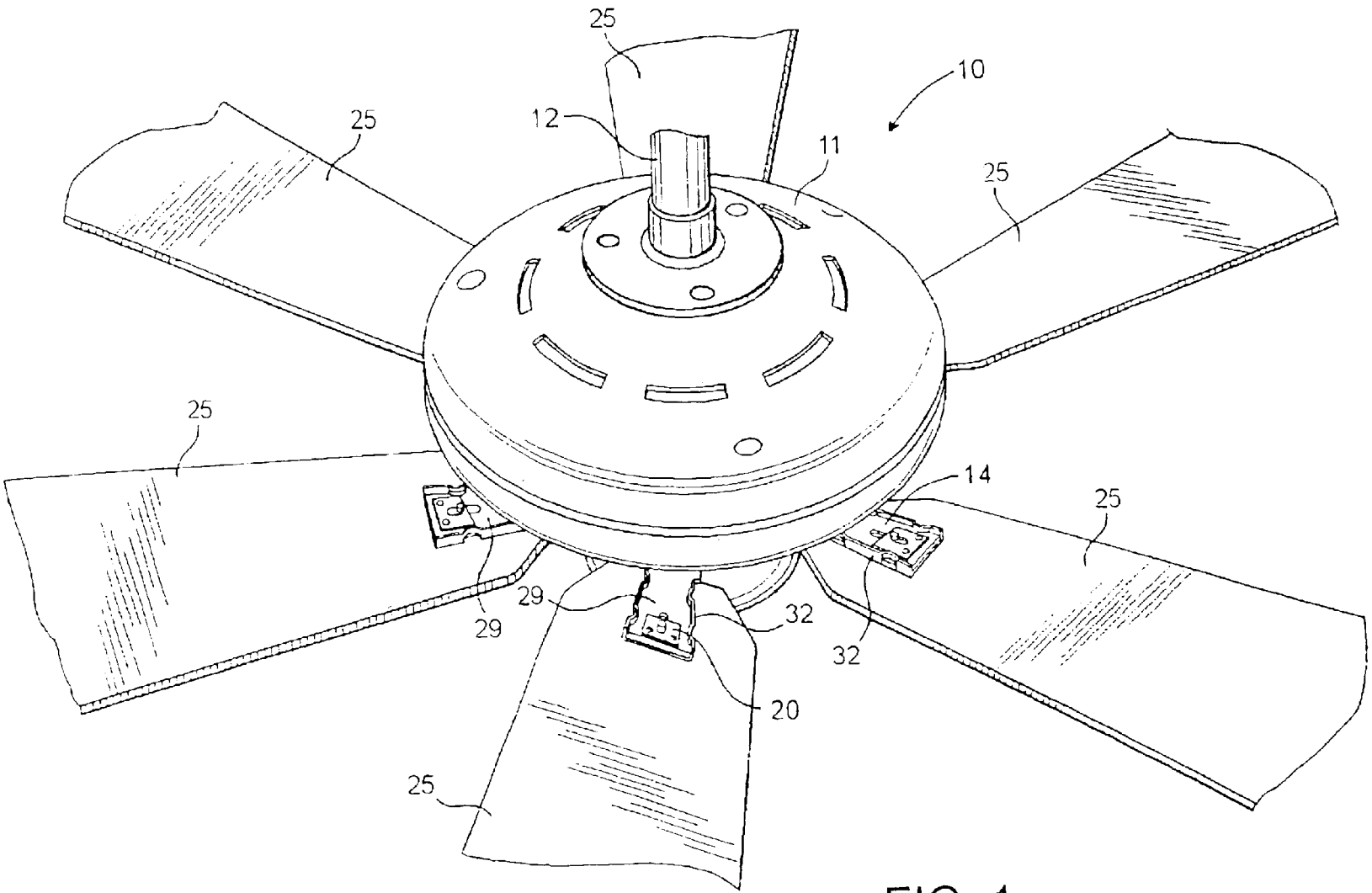
FIG. 1 is a perspective view of the top of a ceiling fan that embodies principles of the invention in its preferred form.
Figure 6A:
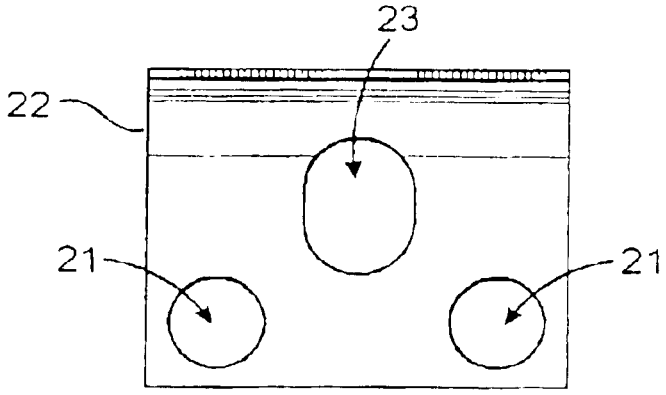
Figure 6B:
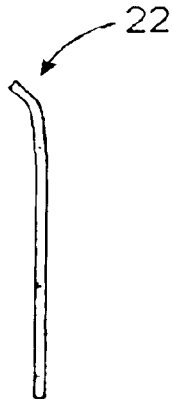
FIG. 6B is a side view thereof.

Referring now in more detail to the drawing, there is shown a ceiling fan 10 having a motor housing 11 suspended from an unshown ceiling by a downrod or rod 12. An unshown electric motor is mounted with the housing 11 and connected to a source of electric power by wires that extend through the rod 12. The motor rotatably drives an annular blade iron that has six radiating extensions or fins 14 that are slightly tilted so that blades mounted thereon have an angle of attack as they are rotated to create a downward or upward flow of air depending upon the other direction of rotation. Each of these extensions is also referred to herein as a blade iron. They are essentially mounting tabs but are referred to in the trade as irons. Each blade iron (extension) is seen to be of a generally trapezoidal shape so that their side edges 15 taper outwardly as they extend from the motor housing. Each is formed with two threaded mounting holes 16 and a slot 17. Each side edge 15 is formed with two notches 18. A resilient leaf spring clip 20 in drawing FIG. 1 is mounted atop each blade iron by unshown screws passed through clip holes 21. As best seen in FIGS. 6A and 6B, the clip has a flat portion in which the holes 21 are formed and a raised, arcuate portion 22. A racetrack shape slot 23 spans the portions 22 and 23.

Figure 2:
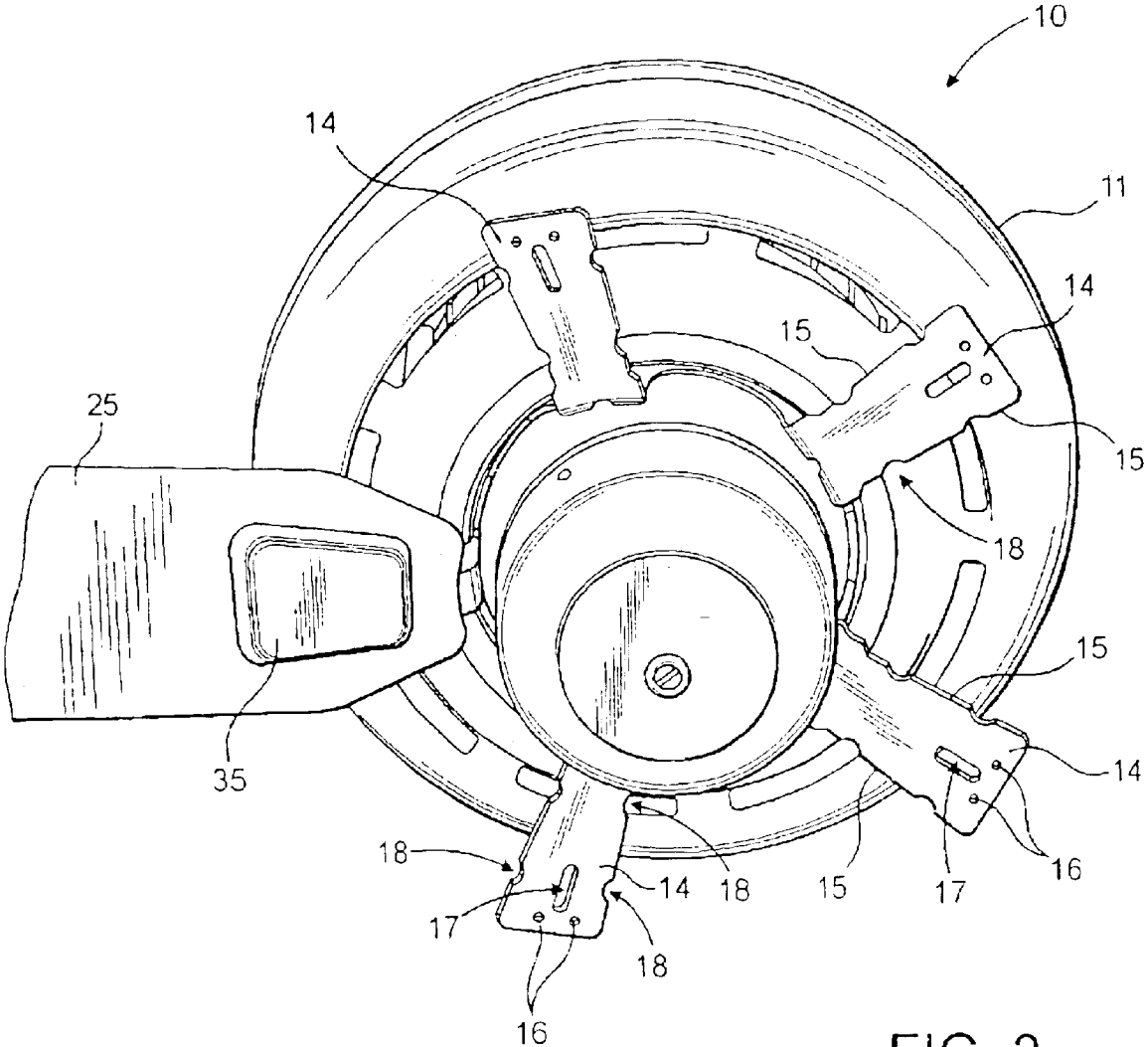
FIG. 2 is a perspective view of the bottom of the ceiling fan shown with several of its blades removed.
Figure 3:
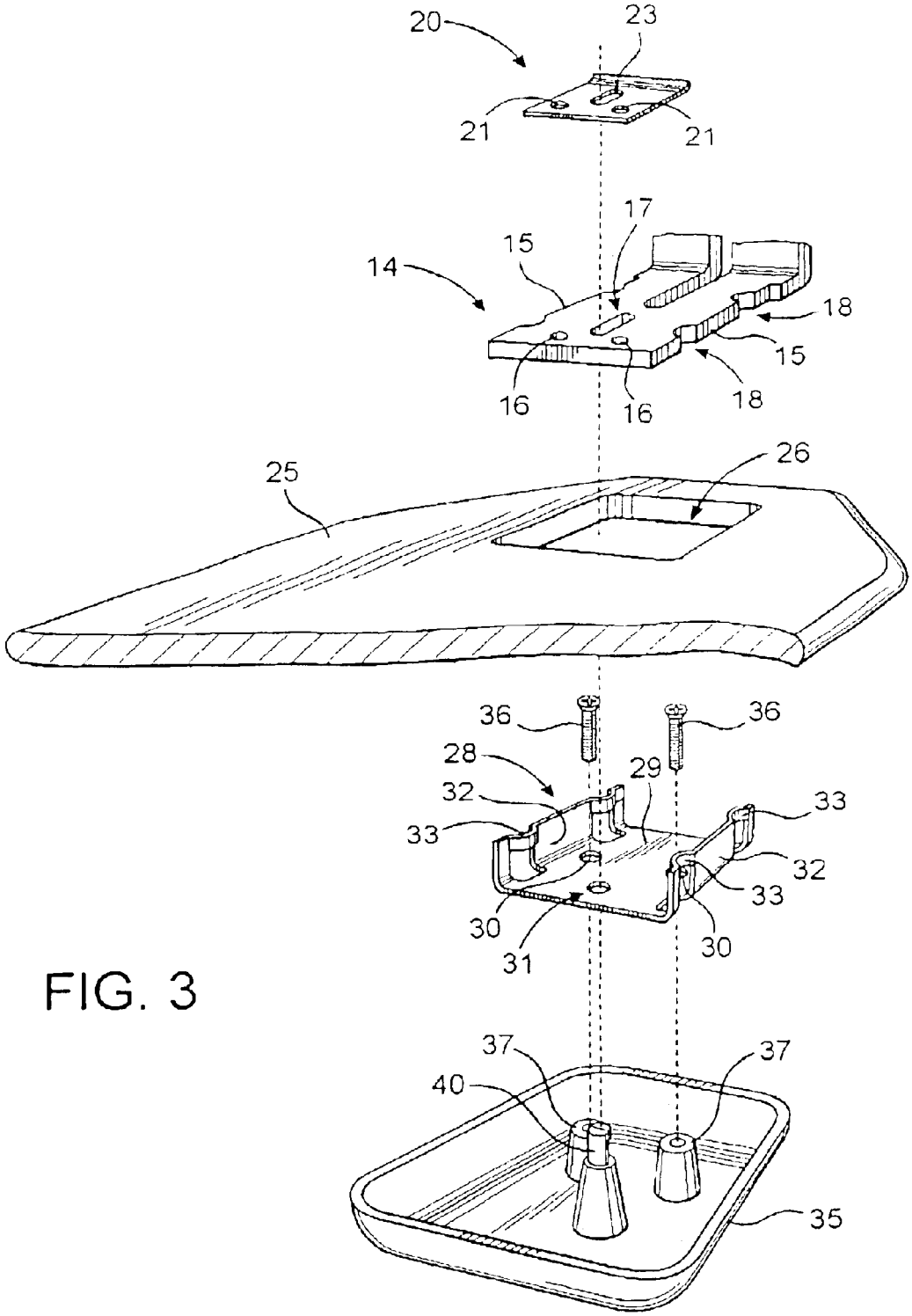
FIG. 3 is an exploded view of parts employed in mounting one of the fan blades.
Figure 4:
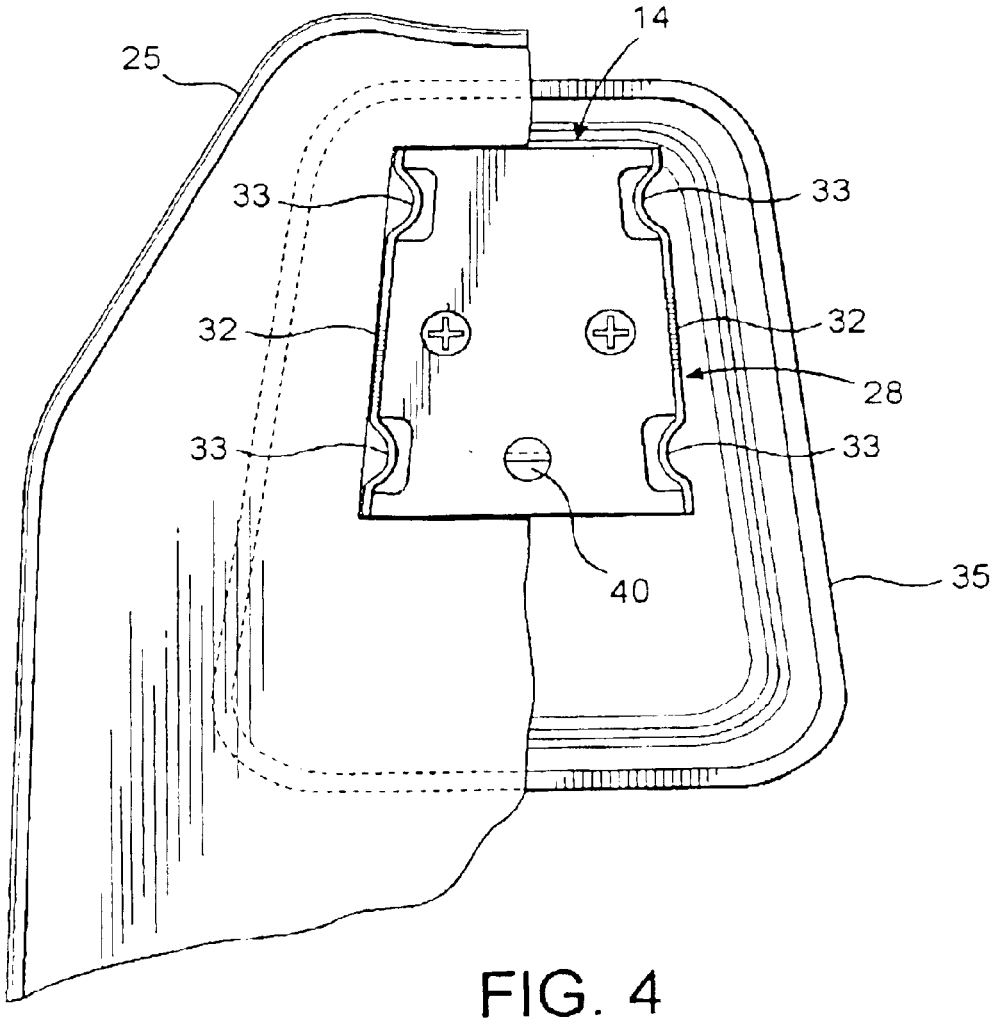
FIG. 4 is a top view of a portion of the fan.
Figure 5:
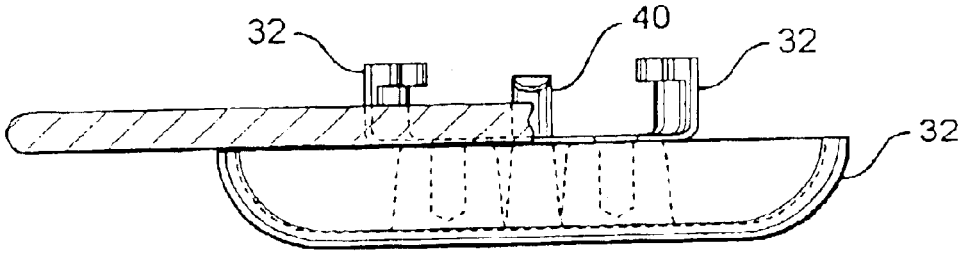
FIG. 5 is a side view of the portion of the fan shown in FIG. 4.

With continued reference to the drawing, the ceiling fan 10 is further seen in FIG. 1 to have six fan blades 25 while FIG. 2 shows the concept with 5 blade irons. Each blade is formed with a trapezoidal opening 26 near its inboard end as best shown in FIG. 3. By inboard is meant that portion closer to the fan's axis of rotation. A bracket 28 is press-fitted into the blade opening 26. The bracket has a flat floor 29 in which two mounting holes 30 and one pass-through hole 31 are formed. Divergent, opposed sides 32 of the bracket are formed with two arcuate indentations 33 adjacent to the upper edge of the bracket sides. A decorative medallion 35 is mounted flushly against the bottom of the fan blade 25 by two screws 36 passed through the two bracket mounting holes 30 and threaded into two medallion bosses 37. A pin 40 extends from the medallion through the bracket pass-through hole 31. The top of the pin 40 is beveled.

So constructed the fan blades 25 may be easily and quickly dismounted from the blade irons 14 in two steps. First, the blade is raised upwardly against the bottom of the blade iron to bring its bracket 28 into a position cradling the blade iron 14. As this is done, pin 40 passes through blade iron slot 17 so as to project above the blade iron, and the four bracket indentations 33 pass through the four blade iron notches 18. The blade with its bracket 28 is then moved outwardly away from the fan's axis. This action moves the bracket indentation 33 into a position aside the blade iron notches 18 with the bracket indentations pressed against the top surface of the blade iron thereby capturing and becoming locked to the blade iron. This also causes the divergent sides of the bracket to be wedged snugly against the divergent sides 15 of the blade iron. Simultaneously, the beveled top of the pin 40 is driven against the raised portion of the resilient clip causing it to flex upwardly until the pin enters the clip slot 23. As this occurs, the raised portion of the clip springs back thereby capturing the pin within the slot 23. In this manner, the bracket and blade become interlocked vertically, horizontally and laterally. Rotation of the blades can only allow minimal slope as the pin 40 engages an end of the racetrack shaped slot 17. Rotations of the blades during fan use between the bracket and blade iron also enhances the security of the mounting as it increases the wedging force.

To dismount a blade, the raised end of the clip is simply raised and the blade moved radially inboard. This movement causes the pin 40 to become free of the clip 20 and the bracket positioned to fall free from the blade iron.

It thus is seen that a ceiling fan is now provided of a construction that enables their blades to be mounted and dismounted easily, quickly and in a reliable and secure manner. Although the invention has been illustrated and described in its preferred form, it should be understood that many modifications, deletions and additions may be made thereto without departure from its spirit and scope as set forth in the following claims.

What is claimed is:

1. A ceiling fan comprising an annular array of blade irons adapted to be rotatably driven by a motor, a mounting pin projecting upwardly from each of said blade irons, and a plurality of fan blades each bearing a mounting clip having a resilient portion that extends above said blade which is formed with a slot sized to receive and grip one of said pins as the blade is slid outboard atop a blade iron and to ungrip said pin as the blade is slid inboard.

2. The ceiling fan of claim 10 wherein said mounting clips are mounted atop said blades.

3. The ceiling fan of claim 1 wherein each of said blade irons has a slot and wherein said pins extend upwardly through said blade iron slots from a medallion that is mounted to the bottom of said blade irons.

4. The ceiling fan of claim 1 wherein the tops of said pins are beveled.

5. A method of mounting a fan blade to a blade iron of a ceiling fan which comprises the steps of sliding the blade inboard atop the blade iron so as to bring a pin projecting upwardly from the blade iron through a slot in the blade and into contact with a resilient clip mounted atop the blade, and following pin contact further sliding the blade inboard causing the pin to flex the clip until the pin enters a slot in the clip whereupon the clip springs back and captures the pin.

6. A ceiling fan comprising an annular array of blade irons adapted to be rotatably driven by a motor, said blade irons having a relatively narrow portion and a relatively wide portion, a plurality of fan blades each bearing a bracket having opposed inward projections spaced apart a distance greater than said blade iron narrow portion and less than said blade iron wide portion, whereby the blades may be mounted to the blade irons by passing the blade brackets inward projection from beneath to a position above the blade iron narrow portions and then sliding the brackets to a position with the bracket inward projections overlaying the blade iron wide portions thereby interlocking the blade brackets with the blade irons.

7. A ceiling fan comprising an annular array of blade irons adapted to be rotatably driven by a motor, said blade irons having opposite sides formed with at least one notch, a plurality of fan blades with each blade bearing a bracket having opposite side walls, each formed with at least one indentation sized and positioned to be passed through said blade iron side notches, and wherein said blade irons have opposite sides formed with at least two notches and wherein said fan blade brackets have opposite side walls each formed with at least two indentations sized and positioned to be passed through said blade iron side notches, whereby the blades may be mounted to the blade irons by passing the blade bracket indentations through the blade iron notches and then sliding the brackets to a position with the bracket indentations unaligned with the blade iron notches thereby interlocking the blade brackets with the blade irons.

8. A ceiling fan comprising an annular array of blade irons adapted to be rotatably driven by a motor, said blade irons having opposite sides formed with at least one notch, a plurality of fan blades with each blade bearing a bracket having opposite side walls, each formed with at least one indentation sized and positioned to be passed through said blade iron side notches, and wherein said blade iron sides are tapered and said bracket side walls are tapered whereby the bracket tapered side walls may be wedged against the blade iron tapered sides, whereby the blades may be mounted to the blade irons by passing the blade bracket indentations through the blade iron notches and then sliding the brackets to a position with the bracket indentations unaligned with the blade iron notches thereby interlocking the blade brackets with the blade irons.

9. The ceiling fan of claim 8 wherein said blade bears an upwardly projecting pin and said blade iron bears a resilient leaf spring clip having a slot sized and located to receive and releasibly capture said blade pin as the bracket tapered side walls are brought into wedging engagement against the blade iron tapered sides.

10. A ceiling fan comprising an annular array of blade irons adapted to be rotatably driven by a motor, said blade irons having opposite sides formed with at least one notch, a plurality of fan blades with each blade bearing a bracket having opposite side walls, each formed with at least one indentation sized and positioned to be passed through said blade iron side notches, and wherein said blade bears an upwardly projecting pin and said blade iron bears a resilient leaf spring clip having a slot sized to receive and releasibly capture said blade pin, whereby the blades may be mounted to the blade irons by passing the blade bracket indentations through the blade iron notches and then sliding the brackets to a position with the bracket indentations unaligned with the blade iron notches thereby interlocking the blade brackets with the blade irons.

11. The ceiling fan of claim 10 wherein the top of said pin is beveled.

* * * * *